United States Patent [19]

Fitzgerald

[11] 4,315,071

[45] Feb. 9, 1982

[54] POLYSTYRYL AMINE POLYMERIC BINDERS FOR PHOTOGRAPHIC EMULSIONS

[75] Inventor: Maurice J. Fitzgerald, Canton, Mass.

[73] Assignee: Polaroid Corporation, Cambridge, Mass.

[21] Appl. No.: 249,000

[22] Filed: Mar. 30, 1981

[51] Int. Cl.[3] ..... G03C 1/02

[52] U.S. Cl. ..... 430/627; 430/630; 430/631

[58] Field of Search ..... 430/627, 630, 631

[56] References Cited

U.S. PATENT DOCUMENTS

| | | | |
|---|---|---|---|
| 3,396,030 | 8/1968 | Haas | 96/114 |
| 3,479,186 | 11/1969 | Taylor et al. | 96/114 |
| 3,681,079 | 8/1972 | Fitzgerald | 96/114 |
| 3,709,690 | 1/1973 | Cohen et al. | 430/627 |
| 3,713,834 | 1/1973 | Fitzgerald | 96/114 |
| 3,721,565 | 3/1973 | Fitzgerald | 96/114 |
| 3,746,548 | 7/1973 | Fitzgerald et al. | 96/113 |
| 3,799,781 | 3/1974 | Fitzgerald | 96/113 |
| 3,799,782 | 3/1974 | Fitzgerald | 96/113 |
| 3,816,129 | 6/1974 | Fitzgerald | 96/114 |
| 3,832,185 | 8/1974 | Fitzgerald | 96/114 |
| 3,852,073 | 12/1974 | Fitzgerald | 96/114 |
| 3,861,918 | 1/1975 | Fitzgerald | 96/114 |
| 3,879,205 | 4/1975 | Fitzgerald et al. | 96/114 |
| 4,022,623 | 5/1977 | Fitzgerald et al. | 96/114 |
| 4,055,429 | 10/1977 | Holmes et al. | 430/627 |
| 4,089,688 | 5/1978 | Fitzgerald | 96/114 |
| 4,120,727 | 10/1978 | Fitzgerald | 96/114 |
| 4,131,471 | 12/1978 | Fitzgerald | 96/114 |

*Primary Examiner*—Jack P. Brammer

*Attorney, Agent, or Firm*—Louis G. Xiarhos

[57] ABSTRACT

A photosensitive silver halide emulsion wherein the emulsion binder comprises a styryl amine polymer or copolymer.

10 Claims, No Drawings

POLYSTYRYL AMINE POLYMERIC BINDERS FOR PHOTOGRAPHIC EMULSIONS

In general, practical uses of photosensitive photographic emulsions require a binder of a suitable, transparent material that accommodates coating and subsequent drying to form a flexible layer. The binder further must provide a medium that features the property of colloid protection; the emulsion binder must be able to form absorption layers on microcrystals of silver halide which permit a stable suspension to be obtained and do not prevent growth of the silver halide microcrystals during physical ripening. To avoid undesirable interference, the emulsion medium preferably should be absent photographic activity, or at least exhibit a constant photographic activity for which suitable compensation can be designed. Solubility in water solution also is required.

Gelatin continues to enjoy a preeminent position in photographic emulsion preparation. Nevertheless, it exhibits known disadvantages. It is difficult to produce gelatin of consistent quality and with nonvarying physical and photographic properties. Most of its properties are subject to deterioration in storage, due to bacterial decomposition, or, in the photographic process, due to hydrolysis. In addition, gelatin contains varying quantities of a plurality of naturally occurring impurities, depending on its source, and, also is subject to dimensional changes when exposed to fluctuating conditions of temperature and moisture.

Hence, considerable research effort has been expended in attempts to replace gelatin with alternate emulsion vehicles. Now, according to the present invention, a synthetic polymer photographic emulsion binder has been discovered which comprises a styryl amine polymer. These novel synthetic polymers are not susceptible to the deficiencies of gelatin materials outlined above and may be utilized to replace part or all of the gelatin in photosensitive silver halide emulsions.

The synthetic polymer binder of the present invention comprises a styryl amine polymer having repeating units represented by the formula:

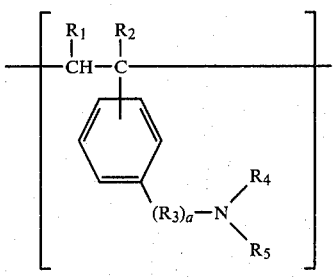

wherein:

$R_1$ is hydrogen, lower alkyl or halogen; $R_2$ is hydrogen, lower alkyl halogen, or cyano; $R_3$ is lower alkylene or cycloalkylene; a is either 0 or 1; and $R_4$ and $R_5$ are independently selected from hydrogen, lower alkyl, lower cycloalkyl, lower nitrogen-containing heterocyclic or phenyl; with the proviso that $R_3$ and/or $R_4$ and/or $R_5$ may be chemically joined to form a 3 to 8 membered heterocyclic ring structure.

Particularly preferred are polymeric units wherein $R_1$ and $R_2$ are both hydrogen; $R_3$ is methylene; and $R_4$ and $R_5$ are independently selected from hydrogen and methyl.

Typical examples of monomers useful in preparing synthetic polymer binders of the present invention include:

1. p - aminostyrene

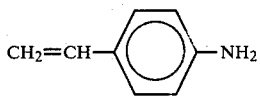

2. m - aminostyrene

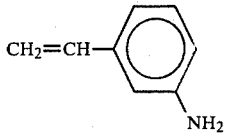

3. o - aminostyrene

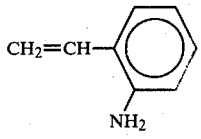

4. p - styrylmethyl dimethylamine

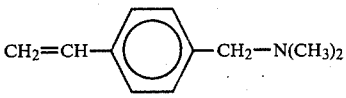

5. N - methyl -4-(α-chloropropenyl) aniline

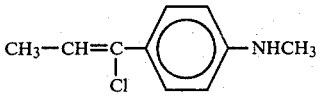

6. p - (dimethylamino) styrene

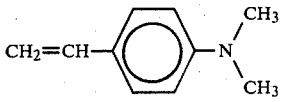

7. N-ethyl - 4 -(1′ - cyano - 1′- butene - 1′ - yl) aniline

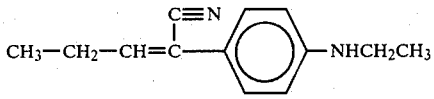

8. N - (p-styrylmethyl) amine diacetic acid dipotassium salt

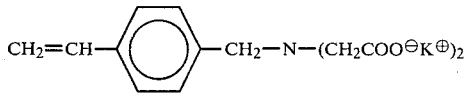

9. 2 -(α - bromo - p - styryl)pyrrolidine

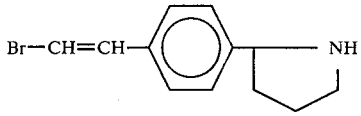

10. 2 - (p - styrylmethylamino) quinuclidine

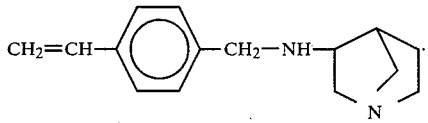

11. 2 - (p-styrylmethylamino) adamantane

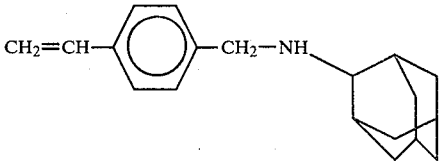

12. N - (β-chloro - p - styryl) - N - cyclopropylmethylamine

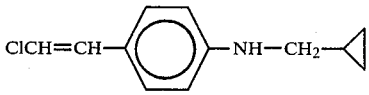

13. N - (p -α - methylstyrylmethyl) aniline

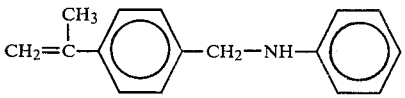

14. N - (p-styrylmethyl) pyrrolidine

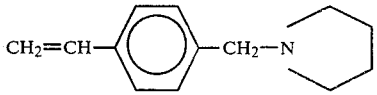

15. α - chloro - p - [β- (dimethylamino) ethyl] styrene

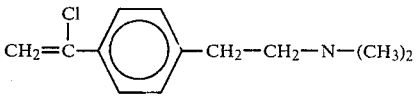

Specific examples of particularly preferred monomers include:

p -(dimethyamino) styrene;

m - aminostyrene; and p - styrylmethyl dimethylamine.

The instant polymers may be homopolymers or interpolymers having, in addition to the repeating polymeric units described above, any compatible repeating unit or various repeating units which are not detrimental to photographic silver halide emulsions and which enhance the water solubility of the resultant polymer. Examples of typical comonomers useful in preparing synthetic polymer binders of the present invention include the following ethylenically unsaturated monomers:

$CH_2{=}CH{-}COOH$ 16.
acrylic acid $CH_2{=}C(CH_3){-}COOH$ 17.
methacrylic acid $CH_2{=}CH{-}COO{-}CH_3$ 18.
methyl acrylate $CH_2{=}CH{-}COO{-}CH_2CH_2CH_2OH$ 19.
γ-hydroxypropyl acrylate $CH_2{=}CH{-}CO{-}NH_2$ 20.
acrylamide $CH_2{=}C(CH_3){-}CO{-}NH_2$ 21.
methacrylamide $CH_2{=}CH{-}CO{-}NH{-}CH_2{-}CO{-}NH_2$ 22.
acrylamidoacetamide $CH_2{=}C(CH_3){-}CO{-}NH{-}CH_2{-}CO{-}NH_2$ 23.
methacrylamidoacetamide

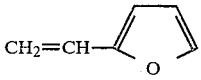

24.
γ-vinylfuran

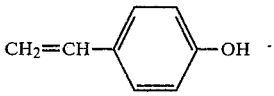

25.
p-hydroxystyrene

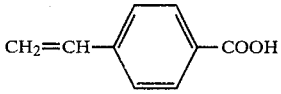

26.
p-carboxystyrene $CH_2{=}CH{-}CO{-}NH{-}CH(COOH){-}CH{-}(CH_3)_2$ 27.
N-acryloylvaline The synthetic polymer binder of the present invention preferably comprises a copolymer of a styryl amine and a suitable comonomer, as defined above. Particularly preferred are copolymers of acrylamide and styryl amine monomers having the general formula:

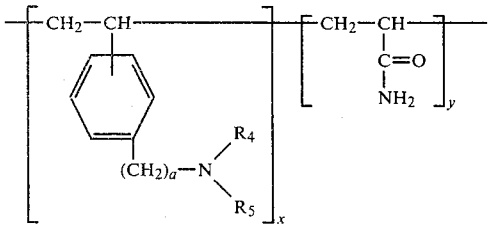

wherein: $R_4$ and $R_5$ are independently selected from hydrogen and methyl; a is 0 or 1; and x and y are positive integers having a ratio of x:y ranging from about 1:4 to about 1:10. Specific preferred polymers are copoymers of acrylamide and p-dimethylamino) styrene, m-aminostyrene, or p-styrylmethyl dimethylamine.

Polymerization of the indicated monomers is achieved by conventional polymerization techniques.

The following general procedure may be used for preparing photographic emulsions using the above described polymers of the instant invention as the colloid binder.

A water-soluble silver salt, such as silver nitrate, may be reacted with at least one water-soluble halide, such as potassium, sodium, or ammonium bromide, preferably together with potassium, sodium or ammonium iodide, in an aqueous solution of the polymer. The emulsion of silver halide thus-formed contains water-soluble salts, as a by-product of the double decomposition reaction, in addition to any unreacted excess of the initial salts. To remove these soluble materials, the emulsion may be centrifuged and washed with distilled water to a low conductance. The emulsion may then be redispersed in distilled water. To an aliquot of this emulsion may be added a known quantity of a solution of bodying or thickening polymer, such as polyvinyl alcohol having an average molecular weight of about 100,000 (commercially available from E. I. duPont deNemours & Company, Wilmington, Delaware, designated Type 72-60). A surfactant, such as dioctyl ester of sodium sulfosuccinic acid, designated Aerosol OT, (commercially available from American Cyanamid Company, New York, N.Y.), may be added and the emulsion coated onto a film base of cellulose triacetate sheet having a coating of hardened gelatin.

Alternatively, the soluble salts may be removed by adding to the emulsion a solution of polyacid, such as 1:1 ethylene: maleic acid copolymer, and lowering the pH to below 5, thereby bringing about precipitation of the polyacid carrying the silver halide grains along with the precipitate. The resulting precipitate may then be washed and resuspended by redissolving the polyacid at pH 6-7.

The emulsions may be chemically sensitized with sulfur compounds such as sodium thiosulfate or thiourea, with reducing substances such as stannous chloride; with salts of noble metals such as gold, rhodium and platinum; with amines and polyamines; with quaternary ammonium compounds such as alkyl $\alpha$-picolinium bromide; and with polyethylene glycols and derivatives thereof.

The emulsions of the present invention may also be optically sensitized with cyanine and merocyanine dyes. Where desired, suitable antifoggants, toners, restrainers, developers, accelerators, preservatives, coating aids, plasticizers, hardeners and/or stabilizers may be included in the composition of the emulsion.

The emulsions of this invention may be coated and processed according to conventional procedures of the art. They may be coated, for example, onto various types of rigid or flexible supports, such as glass, paper, metal, and polymeric films of both the synthetic type and those derived from naturally occurring products. As examples of specific materials which may serve as supports mention may be made of paper, aluminum, polymethacrylic acid, methyl and ethyl esters, vinylchloride polymers, polyvinyl acetal, polyamides such as nylon, polyesters such as polymeric film derived from ethylene glycol-terephthalic acid, and cellulose derivatives such as cellulose acetate, triacetate, nitrate, propionate, butyrate, acetate propionate, and acetate butyrate. Suitable subcoats may be provided on the supports, for example a layer of gelatin, if necessary or desirable for adherence, as is well known in the art.

The preparation of photographic silver halide emulsions employing as binders the styryl amine polymers and copolymers of the present invention is further illustrated by the following nonlimiting examples.

EXAMPLE I p-Vinylbenzyl dimethylamine:Acrylamide copolymer

A solution of 11.36 g. (0.16 mole) acrylamide and 6.44 g. (0.04 mole) p-vinylbenzyl dimethylamine was prepared in 160 ml of distilled water containing about 4.6 g. of acetic acid, in a flask under nitrogen. Ammonium peroxydisulfate (0.016 g.) and sodium bisulfite (0.016 g.) were then added and the flask was again flushed with nitrogen. The solution was allowed to remain at room temperature for about 48 hours. Addition of dilute alkali precipitated out the copolymer which was washed several times with distilled water until the pH of the wash was neutral. The polymer was collected, dissolved in ethanol and then precipitated into acetone. The precipitate was dried under vacuum to yield 5 grams of product.

1.0 g. of acrylamide:p-vinylbenzyl dimethylamine copolymer, as prepared above, was dissolved in 53.35 g. of distilled water with stirring and the dropwise addition of 3.0 ml of 10% sulfuric acid. 0.668 g. of potassium bromide and 0.529 g. of potassium iodide then were added with stirring. The resulting solution had a pH of 2.03 and was maintained at 80° C.

A solution of 77.8 g. of potassium bromide in 300 ml of distilled water was prepared. A second solution of 44.10 g. of silver nitrate in 300 ml of distilled water was prepared. Both solutions were maintained at a temperature of 80° C. 90 ml of the potassium bromide solution and 90 ml of the silver nitrate solution were separately added simultaneously with constant agitation to the polymer solution over a period of about 20 minutes. Thereafter, the emulsion was rapidly cooled to below 20° C. The emulsion then was flocculated by raising the pH to 6.86 by the dropwise addition of a concentrated solution of potassium hydroxide. The supernate which was decanted off had a conductivity of 60 umhos. The floc was redispersed in distilled water adjusted back to pH 6.86 and then was centrifuged. The first wash was decented off and had a conductivity of 3900 umhos. The emulsion was brought to a volume of 250 ml with distilled water and redispersed. The emulsion grains were octahedral platelets having a mean number diameter of 0.51 microns.

To 23.8 g. of this emulsion was added 18.7 g. of a 2.67% polyacrylamide bodying polymer solution (obtained commercially from American Cyanamid Company under the trademark designation CYANAMER P-250), 0.5 g. of 1% mucochloric acid as a hardener, and 3.0 ml of 1% solution of a nonionic surfactant (obtained commercially under the trademark designation NEUTRONYX N-600 from Onyx Oil and Chemical Co.). The emulsion was slot coated onto a base of cellulose triacetate (125 microns thick) at a coverage of 860 mg/m$^2$ Ag, 430 mg/m$^2$ polyacrylamide and 4.3 mg/m$^2$ mucochloric acid. The film so prepared was air dried, exposed on a sensitometer and processed with a processing composition and receiving sheet from a Polaroid Land Type 42 black and white film assembly. The negative and image-receiving element were maintained in superposed position for 15 seconds and then stripped apart. The photographic characteristics of the positive print were measured with an automatic recording densitometer to show readings of 1.72 Dmax and 0.00 Dmin and a speed of about 15 ASA.

EXAMPLE II

Poly p-(dimethylamino) styrene

The polymerization was carried out in bulk using azobisisobutyronitrile (AIBN) as an initiator. The viscous solution obtained was precipitated into hexane.

2.2 g. of the product poly p-(dimethylamino) styrene was dissolved in 400 ml of distilled water and adjusted to pH 1.16 with nitric acid. 1.20 g. of dry potassium bromide and 1.50 g. of dry potassium iodide were dissolved in this solution. The solution was put into a stainless steel vessel and was stirred and maintained at 50° C. using a water bath.

A second solution was prepared by dissolving 120.0 g. of dry potassium bromide in 500 ml of distilled water; a third solution was prepared by dissolving 82.5 g. of dry silver nitrate in 500 ml of distilled water. Both these solutions were maintained at 50° C. and separately added simultaneously over a continuous period of 22 minutes to the first solution, with stirring.

Thereafter, the emulsion was maintained at 50° C. with stirring, for one hour and then rapidly cooled to 20° C.

Next, the emulsion was coated onto a clear cellulose triacetate sheet. Following air drying, the film was exposed on a sensitometer and processed with a processing composition and receiving sheet from a Polaroid Land Type 42 black and white film assembly at a 0.0022 inch gap for 15 seconds. After separation, the receiving sheet had a positive silver transfer image with Dmax=1.20, a Dmin=0.77.

EXAMPLE III m-Aminostyrene:Acrylamide copolymer

A solution of 7.11 g. acrylamide, 2.38 g. m-aminostyrene and 0.01 g. azobisisobutyronitrile (AIBN free radical initiator) were dissolved in 80 ml of dimethylformamide (DMF). The solution was placed in sealed tubes under an atmosphere of nitrogen and polymerized at 65° C. for 12 hours. The resulting polymer product was isolated by precipitation in acetone. The precipitate was dried under vacuum at 45° C. overnight (about 16 hours) to yield 5.43 g. of polymer product.

4.15 g. of the polymer product was dissolved in 266 ml of distilled water. The solution was adjusted to pH 3.0 with dilute nitric acid and was maintained at 55° C. To this solution, 88.0 g. of dry potassium bromide and 1.0 g. of dry potassium iodide were added.

A second solution of 55 g. of silver nitrate in 500 ml of distilled water was prepared. 100 ml of this silver nitrate solution was added rapidly with continuous agitation to the first polymer-halide solution; an additional 396 ml was slowly added over a period of 22 minutes. Thereafter, the emulsion was ripened for 60 minutes at 55° C., and then cooled to below 20° C.

The emulsion grains were mostly octahedral crystals with diameters ranging from 0.2 to 1.3 microns. The average diameter was 0.5 microns.

What is claimed is:

1. A photosensitive silver halide emulsion comprising silver halide crystals disposed in an emulsion binder comprising a styryl amine polymer with repeating units having the general formula:

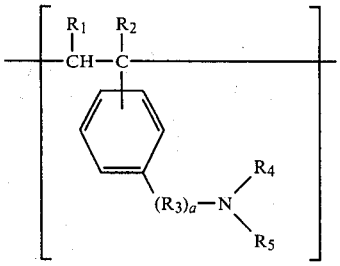

wherein:

$R_1$ is hydrogen, lower alkyl or halogen; $R_2$ is hydrogen, lower alkyl halogen, or cyano; $R_3$ is lower alkylene or cycloalkylene; a is either 0 or 1; and $R_4$ and $R_5$ are independently selected from hydrogen, lower alkyl, lower cycloalkyl, lower nitrogen-containing heterocyclic or phenyl; with the proviso that $R_3$ and/or $R_4$ and/or $R_5$ may be chemically joined to form a 3 to 8 membered heterocyclic ring structure.

2. The emulsion of claim 1 wherein: $R_1$ and $R_2$ are both hydrogen; $R_3$ is methylene; and $R_4$ and $R_5$ are independently selected from hydrogen and methyl.

3. The emulsion of claim 2 comprising a styryl amine polymer prepared from monomers selected from the group consisting of:

p-(dimethylamino) styrene;
m-aminostyrene;
p-styrylmethyl dimethylamine.

4. The emulsion of claim 3 comprising m-aminostyrene.

5. The emulsion of claim 1 comprising a styryl amine copolymer.

6. The emulsion claim 5 comprising a copolymer of a styryl amine and an acrylamide monomer.

7. The emulsion of claim 6 comprising a copolymer with repeating units having the general formula:

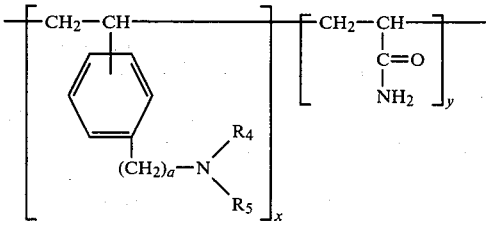

wherein: $R_4$ and $R_5$ are independently selected from hydrogen and methyl; a is 0 or 1; and x and y are positive integers having a ratio of x:y ranging from about 1:4 to about 1:10.

8. The emulsion of claim 7 wherein the styryl amine monomer is selected from the group consisting of p-dimethylamino) styrene; m-aminostyrene; and p-styrylmethyl dimethylamine.

9. The emulsion of claim 8 comprising a copolymer of p-styrylmethyl dimethylamine and acrylamide.

10. The emulsion of claim 9 wherein the ratio of p-styrylmethyl dimethylamine to acrylamide is about 1:4.

* * * * *